US007875815B2

(12) United States Patent
Honmatsu

(10) Patent No.: US 7,875,815 B2
(45) Date of Patent: Jan. 25, 2011

(54) KEY SHEET AND PUSHBUTTON SWITCH

(75) Inventor: Yoshifumi Honmatsu, Tokyo (JP)

(73) Assignee: Polymatech Co., Ltd., Tokyo (JP)

( * ) Notice: Subject to any disclaimer, the term of this patent is extended or adjusted under 35 U.S.C. 154(b) by 796 days.

(21) Appl. No.: 11/819,987

(22) Filed: Jun. 29, 2007

(65) Prior Publication Data

US 2008/0000766 A1 Jan. 3, 2008

(30) Foreign Application Priority Data

Jun. 30, 2006 (JP) ..... 2006-182765

(51) Int. Cl.
*H01H 9/26* (2006.01)

(52) U.S. Cl. ..... 200/5 A

(58) Field of Classification Search ..... 200/5 R, 200/5 A, 512–517, 308, 310–314, 317
See application file for complete search history.

(56) References Cited

U.S. PATENT DOCUMENTS

| | | | | |
|---|---|---|---|---|
| 5,136,131 | A | 8/1992 | Komaki | |
| 5,607,048 | A * | 3/1997 | Kaizu et al. | 200/314 |
| 5,901,834 | A * | 5/1999 | Inubushi et al. | 200/314 |
| 2002/0030987 | A1 | 3/2002 | Saito et al. | |
| 2003/0173201 | A1 * | 9/2003 | Ohashi | 200/517 |
| 2006/0267937 | A1 * | 11/2006 | Takatsuka et al. | 345/160 |

FOREIGN PATENT DOCUMENTS

JP 2003-323827 A 11/2003

OTHER PUBLICATIONS

Communication from European Patent Office for application No. 07011729.6-2214 dated Nov. 6, 2007.

* cited by examiner

*Primary Examiner*—Edwin A. Leon
(74) *Attorney, Agent, or Firm*—Cermak Nakajima LLP; Tomoko Nakajima

(57) ABSTRACT

The present invention provides a key sheet in which adjacent key tops are prevented from moving in conjunction with each other even when intervals between the key tops are designed to be narrow, and which facilitates a depressing operation by eliminating interference between the adjacent key tops. Further, the present invention provides a pushbutton switch using the above-mentioned key sheet. When a central key top is depressed, a portion of a soft sheet positioned between the key top and the key tops therearound is deformed to a large degree. On the other hand, a hard sheet is flexed entirely to a portion extending to a portion directly below the key tops. As a result, a clearance portion between the soft sheet and the hard sheet is formed. Therefore, the left and right key tops do not move in conjunction with each other, thereby making it possible to prevent erroneous input. Further, the peripheral key tops are not affected by the depressing operation of the central key top, thereby making it possible to suppress a depressing operation load to be small.

12 Claims, 7 Drawing Sheets

KEY SHEET AND PUSHBUTTON SWITCH

BACKGROUND OF THE INVENTION

1. Field of the Invention

The present invention relates to a pushbutton switch for use in an operating portion of various kinds of electronic apparatus such as a mobile phone, a personal digital assistant (PDA), a car navigation device, or a car audio device, and to a key sheet for the pushbutton switch. In particular, the present invention relates to a pushbutton switch used with a plurality of key tops being exposed to an outside through an operation opening formed in a casing of the electronic apparatus, and to a key sheet for the pushbutton switch.

2. Description of the Related Art

There is known a pushbutton switch adopting a key sheet having a plurality of key tops serving as input keys for the electronic apparatus such as a mobile phone or a PDA. A key sheet 1 according to a related art as disclosed, for example, in JP 2003-323827 A has a structure in which key tops 2 are fixed to a surface constituting an operation surface of a base material film 3 as shown in FIG. 13. The base material film 3 has flexibility according to depressing of the key tops 2 and a repulsive force for restoring the key tops 2 to their original positions when the depression is released. The plurality of key tops 2 are fixed to the base material film 3 through intermediation of adhesive layers 4 in a state where the key tops 2 are independent of each other. As described above, the plurality of key tops 2 can be arranged, and elastic restoration can be achieved only by means of the base material film 3, thereby realizing the small and thin key sheet 1 suitable for a small electronic apparatus.

There is a problem with the key sheet 1, in that, in a case where intervals between the key tops 2 are narrowed, when depressing one of the key tops 2, the key tops 2 adjacent thereto are moved in conjunction therewith, thereby causing an erroneous input, or the key tops 2 adjacent thereto tend to move in conjunction (interfere) therewith, to thereby increase a depressing operation load, making the depressing operation difficult.

SUMMARY OF THE INVENTION

The present invention has been made in view of the above-mentioned conventional technique as a background. It is an object of the present invention to provide a key sheet, in which adjacent key tops are prevented from moving in conjunction with each other even when intervals between the key tops are designed to be narrow, and which facilitates the depressing operation by eliminating interference between the adjacent key tops. Further, it is another object of the present invention to provide a pushbutton switch using the above-mentioned key sheet.

In order to achieve the above-mentioned objects, the present invention includes the following structure. That is, the present invention provides a key sheet arranged on a substrate having a contact switch in a casing of an apparatus, the key sheet being characterized by including: an upper member formed of a plurality of key tops which are exposed to an outside through operation openings formed in the casing, and a soft sheet fixed to back surfaces of the key tops; and a lower member which is formed of a hard sheet, on which the upper member is placed, and which forms a clearance portion by which the lower member is spaced apart from the upper member when the key top is depressed.

According to the present invention, the plurality of key tops are fixed not to the hard sheet but to the soft sheet. The soft sheet is placed on the hard sheet without being fixed thereto. When the key top is depressed, a clearance portion by which the upper member is spaced apart from the lower member is formed. Accordingly, when a certain key top is depressed, while a portion of the soft sheet positioned between the key top and the adjacent key tops is partially deformed to a large degree, the hard sheet is not restrained by the key tops or the soft sheet, and is freely deformed. That is, the hard sheet does not move in conjunction with the key tops adjacent to the key top which is depressed and is deformed to be curved as a whole in a wide portion along a plane direction of the key sheet about a depressing position serving as a center.

Accordingly, it is possible to realize the same operability as in a case where one key top and the adjacent key tops are not connected. Thus, when a certain key top is depressed, the adjacent key tops can be prevented from moving in conjunction therewith, thereby making it possible to prevent erroneous input due to the movement of the adjacent key tops in conjunction therewith. Further, the adjacent key tops do not interfere with each other and the depressing operation load can be suppressed.

As compared to the present invention, in a case of a conventional example in which the key tops are directly fixed to the hard sheet, when the certain key top is operated, portions of the hard sheet, which are fixed to the adjacent key tops tend to be flexed, but the portions are restrained by bottom surfaces of the key tops, thereby being difficult to be deformed in curve. Accordingly, a curving deformation in which the hard sheet is curved as a whole does not easily occur. As a result, the depressing operation load becomes larger and the adjacent key tops move in conjunction with each other.

Further, the present invention includes the hard sheet, so is excellent in handleability and is easily mounted to an electronic device. Note that, a coefficient of friction of a contact surface between the soft sheet and the hard sheet is preferably as small as possible, and more preferably, 1.0 or less. In order to reduce the coefficient of friction, fine irregularities are formed on a back surface of the soft sheet or a surface of the hard sheet, thereby reducing a contact area therebetween and making it possible to provide a coating layer of low friction made of a silicone-based or fluorine-based substance on a boundary surface between the soft sheet and the hard sheet.

According to the present invention, in the key sheet, the hard sheet may constitute a circuit sheet, and in particular, the hard sheet may include an EL emitting layer for illuminating the key tops. In the circuit sheet, for example, there is provided the EL emitting layer formed by printing or etching, or an analog or digital touch panel (capacitance switch). The EL emitting layer is formed of a layered body including various functional layers. However, the hard sheet does not cause partial deformation to a large degree when being depressed, while the hard sheet has a tension allowing uniform deformation thereof as a whole, so there does not arise such a problem of durability that the EL emitting layer is easily peeled off. Further, an illuminating direction of the EL emitting layer is stabilized, so the EL emitting layer can stably exert an illuminating function. Further, the EL emitting layer is a planar illuminator, so the EL emitting layer does not require an installation space like that of an LED, thereby making it possible to realize reduction in thickness of the key sheet.

According to the present invention, in the key sheet, the soft sheet is adhered and fixed to an end of the hard sheet. Therefore, it is possible to eliminate a problem of separately positioning the soft sheet and the hard sheet to assemble those to the electronic apparatus, and the key sheet can easily be assembled to the electronic apparatus as a single body.

Further, the soft sheet is fixed by the end of the hard sheet, so the soft sheet is not restrained by the hard sheet, and when the key top is depressed, the soft sheet and the hard sheet can be separately flexed. As a result, the depressing operation load can be reduced.

Further, the present invention provides a pushbutton switch characterized by including: a substrate having a belleville spring serving as a contact switch; and a key sheet for depressing the contact switch, the key sheet being arranged on the substrate, in which the key sheet includes: an upper member formed of a plurality of key tops which are exposed to an outside through operation openings formed in the casing of the apparatus, and a soft sheet fixed to back surfaces of the key tops; and a lower member which is formed of a hard sheet, on which the upper member is placed, and which forms a clearance portion by which the lower member is spaced apart from the upper member when the key top is depressed.

According to the present invention, the key sheet is formed of the upper member and the lower member. The upper member is formed of the plurality of key tops exposed to the outside through the operation openings formed in the casing of the apparatus, and the soft sheet fixed to the back surfaces of the key tops. The lower member is formed of the hard sheet on which the upper member is placed and in which, when the key top is depressed, a clearance portion is formed by which the lower member is spaced apart from the upper member. With this structure, the upper member is not fixed to the lower member and is placed on the lower member. Thus, when the certain key top is depressed, the soft sheet around the depressed key top is partially flexed to a large degree, and without affecting the adjacent key tops, only the depressed key top is pushed in. In this case, the hard sheet is not fixed to the soft sheet, so the hard sheet is flexible in a wide portion along a plane direction thereof, thereby making it possible to reduce the depressing operation load as compared to the case where the hard sheet is partially flexed.

The key sheet arranged on the substrate having the belleville spring serving as the contact switch includes the hard sheet, and allows the hard sheet to be flexed without being affected by the key tops adjacent to the depressed key top. Therefore, it is possible to realize a pushbutton switch capable of taking a depression stroke (pushing-in distance) for depressing the belleville spring, and which has a low depressing load and provides a favorable click feeling.

According to the key sheet and the pushbutton switch using the same of the present invention, at the time of depressing operation, the soft sheet around the key top is partially deformed to a large degree, so the adjacent key tops do not move in conjunction with the depressed key top, thereby making it possible to prevent an erroneous input. Further, the adjacent key tops can be prevented from interfering with each other, so the depressing load can be suppressed to be small. As a result, it is possible to realize the same operability as that of a structure in which the key tops are not connected to each other.

Contents of the present invention are not limited to the above descriptions. An advantage, characteristic point, and use of the present invention will become more obvious through the following descriptions made with reference to the attached drawings. Further, it should be understood that all the appropriate modifications without departing from the spirit of the present invention are included in the scope of the present invention.

DETAILED DESCRIPTION OF THE PREFERRED EMBODIMENTS

Figure 1:
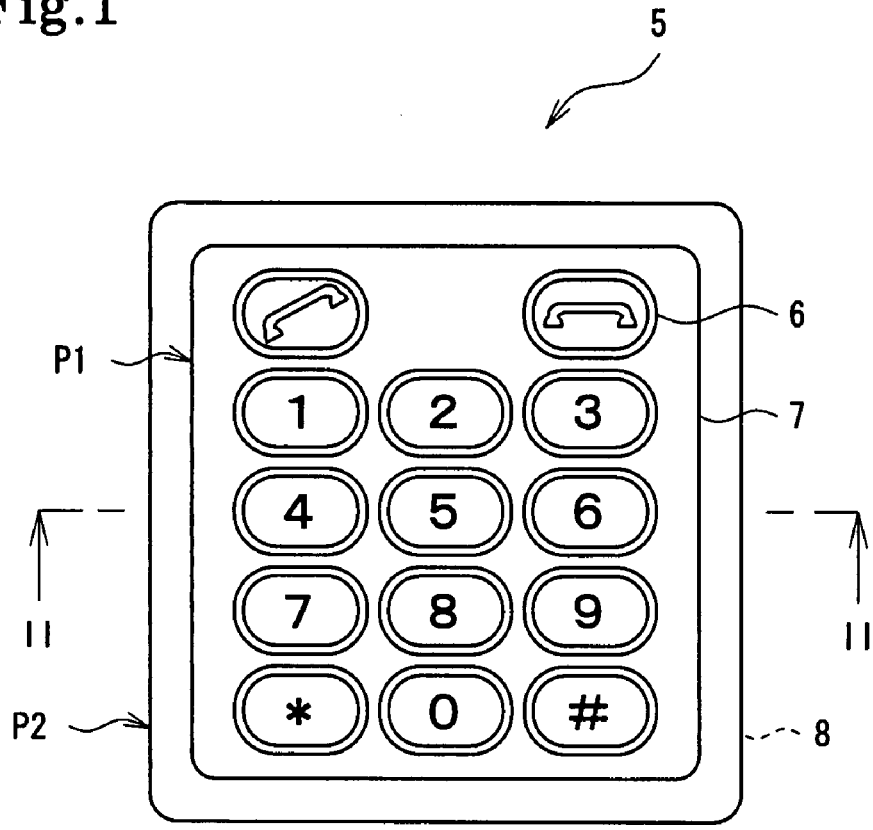
FIG. 1 is a plan view of a key sheet according to a first embodiment of the present invention.

Hereinafter, a description will be made of embodiments of the present invention with reference to the drawings. In the drawings, the same reference symbols denote the same parts and components. Note that, redundant descriptions of structures and materials common among the embodiments will be omitted.

First Embodiment

FIGS. 1 to 5

Figure 2:
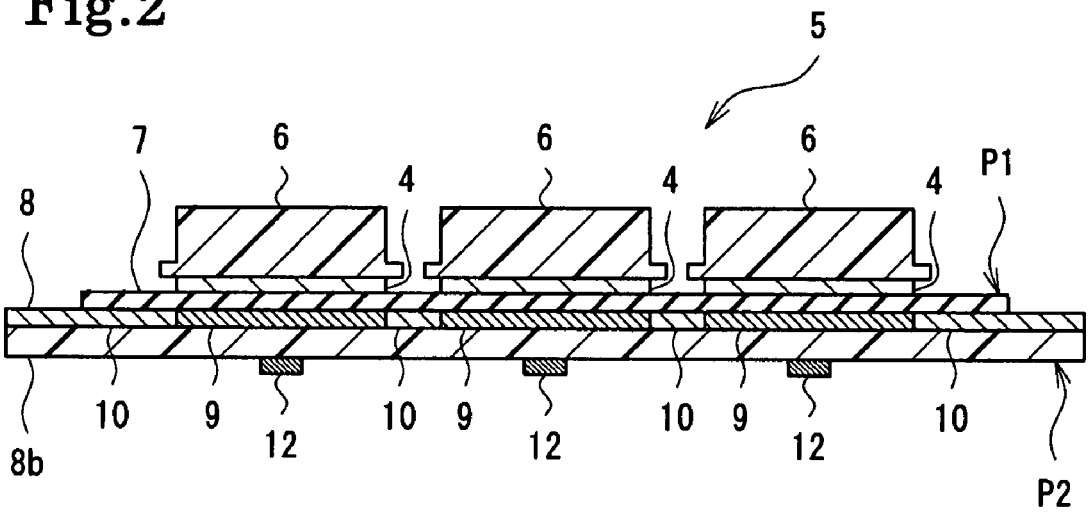
FIG. 2 is a sectional view taken along the line II-II of FIG. 1.
Figure 3:
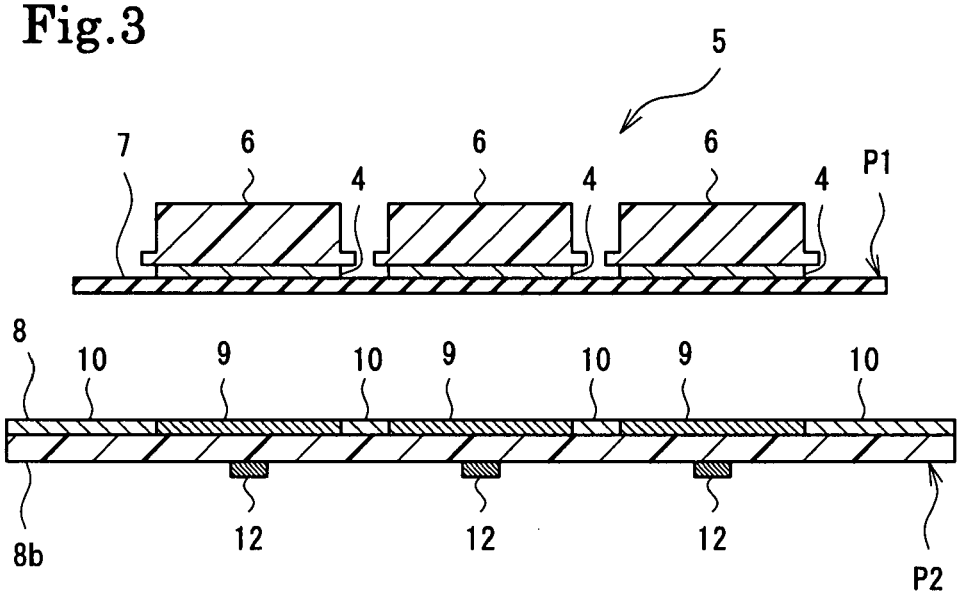
FIG. 3 is a sectional view of an upper member and a lower member of the key sheet according to the first embodiment of the present invention.

A key sheet 5 of a first embodiment of the present invention is shown in FIGS. 1 and 2. The key sheet 5 of the first embodiment includes key tops 6, a soft sheet 7, and a hard sheet 8. As shown in FIG. 3, the key sheet 5 is formed of two separate parts, that is, an upper member P1 composed of the key tops 6 and the soft sheet 7 which are fixed to each other through the intermediation of the adhesive layers 4, and a lower member P2 formed of the hard sheet 8 which is provided with a function layer such as EL emitting layers 9 and an insulating layer 10, and pushers 12, the upper member P1 not being fixed to the lower member P2, thereby being capable of moving away from each other.

Each of the key tops 6 receives a depressing operation by fingers or the like on a surface thereof, that is, an operation surface. Further, the operation surface or a back surface on a side opposite thereto is applied with decoration such as a number, a character, a symbol, or a pattern by printing, transferring a metal foil, or the like, thereby indicating a function or the like of each of the key tops 6. The fourteen key tops 6 shown in FIG. 1 each are fixed to the soft sheet 7 through the intermediation of adhesive layers 4, thereby being prevented from falling apart.

The hard sheet 8 has the EL emitting layers 9 in positions aligned with the key tops 6 on the surface side of the hard sheet 8. The insulating layer 10 is formed on the surface side of the hard sheet 8 in a portion other than the EL emitting layers 9. On the back surface of the hard sheet 8, there are provided the pushers 12 formed so as to protrude therefrom, for depressing contact switches provided on a substrate (not shown), which opposes the hard sheet 8. While the hard sheet 8 is formed in a single plate, in order to enhance flexibility thereof, a slit passing through a thickness of the hard sheet 8 may be provided.

The key tops 6 receive the depressing operation by fingers or the like on the operation surfaces thereof, which are exposed to the outside of the apparatus. Therefore, as a material thereof, it is preferable to use a thermoplastic resin or a reactive resin for satisfying demands for higher mechanical strength and resistance, weight reduction, and the like. Examples of those resins include a polycarbonate resin, a polyethylene terephthalate resin, a polymethyl methacrylate resin, a polypropylene resin, a polystyrene resin, a polyacrylic copolymer resin, a polyolefin resin, an acrylonitrile butadiene styrene resin, a polyester resin, an epoxy resin, a polyurethane resin, a polyamide resin, and a silicone resin. When a consideration is made to workability of those hard resins, it is preferable to use a polycarbonate resin, a polymethyl methacrylate resin, a polyacrylic copolymer resin, or an acrylonitrile butadiene styrene resin. When a consideration is also made to transparency thereof, it is preferable to use a polycarbonate resin, a polymethyl methacrylate resin, or a polyacrylic copolymer resin.

The soft sheet 7 has a function of connecting the plurality of key tops 6 to each other, and has softness with which, when the certain key top 6 is depressed, the other key tops 6 are not affected thereby. For the soft sheet 7 as described above, a rubber-like elastic material such as a soft resin film or a thermoplastic elastomer is used, which is difficult to retain a shape thereof because rubber-like elastic material has a low tension or no tension. Specifically, it is preferable to use a soft material having a tensile elongation based on JIS K7311 of 400% or more and a 100% modulus (tensile stress when elongation is 100%) also based on JIS K7311 of 100 MPa or less. Examples of the material include a solid member of a polyurethane resin, a polyester resin, a polyethylene resin, a polyamide resin, a polyvinyl chloride resin, a polycarbonate resin, a polyethylene terephthalate resin, an acrylic resin, or the like, and a composite of those. Of those, it is suitable to use a resin, which is thinner and softer and is more difficult to be broken than other materials, such as a polyamide resin, a polyurethane resin, a polyester resin, and a polyvinyl chloride resin, silicone rubber, or the like. Note that, in view of an operational feeling of being capable of smoothly depressing the key top 6 at the time of depressing the key top 6 and durability, it is preferable to use a soft resin film. In this embodiment, in order to allow passage of a back light beam to be emitted by the EL emitting layers 9, a transparent resin is preferable. A thickness of the soft sheet 7 is preferably as thin as possible for satisfying a demand for the thinner key sheet 5. However, when the soft sheet 7 is too thin, durability thereof is low. Therefore, the thickness is preferably 5 μm to 300 μm, and more preferably, 5 μm to 100 μm. The soft sheet 7 using a urethane resin of the above-mentioned resins is preferable in a point that the thickness thereof can be reduced to be equal to or less than 50 μm.

The hard sheet 8 is formed by using, as a base, a resilient hard resin film 8*b* having flexibility allowing deformation at the time of depression, and a restoration force (repulsive force) allowing restoration when the depression is released. It is preferable that the hard resin film 8*b* to have rigidity with which a shape of the key sheet 5 as a whole can be retained in a point that the hard resin film 8*b* can be easily incorporated to the apparatus. Further, it is preferable that the hard resin film 8*b* be an electrical insulating resin film having good printability and superior in heat resistance in view of provision of the EL emitting layers 9 or the like. For example, it is possible to use a solid member of a polyethylene terephthalate resin, a polyethylene resin, a polypropylene resin, a polyamide resin, a polyvinyl chloride resin, a polycarbonate resin, an acrylonitrile butadiene styrene resin, a polybutylene terephthalate resin, a polyphenylene oxide resin, a polyphenylene sulfide resin, a polyurethane resin, a polyphenylene ether resin, a modified polyphenylene ether resin, a polyketone resin, or liquid crystal polymer, or a composite of those. A thickness of the hard resin film 8*b* is preferably as thin as possible for satisfying a demand for the thinner key sheet 5. However, when the hard resin film 8*b* is too thin, the EL emitting layers 9 described later are difficult to be provided. Therefore, the thickness is preferably 5 μm to 300 μm, and more preferably 5 μm to 100 μm. Note that, a thickness of the soft sheet 7 and the hard resin film 8*b* as a whole is preferably equal to or less than 200 μm for reducing the thickness, and is more preferably equal to or less than 100 μm.

The EL emitting layers 9 are provided on a surface of the hard resin film 8*b* constituting the base of the hard sheet 8, and a function of emitting light by electrification. The EL emitting layer 9 is formed by successively stacking an insulating layer, a transparent electrode, a light emitting layer, an dielectric layer, and a back plate from the surface side. The transparent electrode and the back plate are connected to a compensation electrode. With regard to materials of those, the insulating layer is made of an insulating resin, examples of the materials which can be used include a polyester-based, vinyl chloride-vinyl acetate-based, acrylic, polycarbonate-based, urethane-based, polyolefin-based, epoxy-based, or silicone-based resin. A transparent electrode is made of a material having transparency and conductivity, and, for example, indium tin oxide (hereinafter, referred to as "ITO") can be used therefor by being formed into a thin film through dry plating or coating. Alternatively, polyacetylene-based conductive polymer, polythiophene-based conductive polymer, polypyrrole-based conductive polymer, polyparaphenylene-based conductive polymer, or the like can be used by being formed into a thin film through coating. The light emitting layer is formed of a coating film including an illuminant particle. The illuminant particle which is obtained by doping zinc sulfide with copper and activating manganese and aluminum can be used. A material obtained by further coating the surface of the resultant with oxide or nitride to enhance moisture resistance is also preferable. The dielectric layer is made of a material having electrical insulating properties and high conductivity. For example, a coating film of a material, which is obtained by dispersing a fine particle of barium titanate into a resin such as a fluorine-based, cyano-based, or polyester-based resin can be used for the dielectric layer. The back plate is made of a material having conductivity. For example, aluminum, silver, ITO, or carbon is subjected to dry plating or coating, and the resultant can be used for the back plate. On the surface of the hard sheet 8, a circuit wiring portion (not shown) connected to the EL emitting layers 9 is also formed by printing. The circuit wiring portion can be formed on the hard sheet 8 by etching a copper foil.

The insulating layer 10 is provided on the surface of the hard resin film 8*b* and in a portion where the EL emitting layers 9 and the circuit wiring portion are not provided. The insulating layer 10 has a function of ensuring insulation of the adjacent EL emitting layers 9. The insulating layer 10 can be formed by using, for example, a polyester-based, vinyl chloride-vinyl acetate-based, acrylic, polycarbonate-based, urethane-based, polyolefin-based, epoxy-based, or silicone-based ink or coating.

The pusher 12 formed on the back surface of the hard sheet 8 has a function of pushing a belleville spring provided on the substrate, and a material of the pusher 12 is preferably a hard resin, that is, a thermoplastic resin, a thermosetting resin, or a photo-setting resin in view of performance of requirement such as higher mechanical strength and durability, and of weight reduction. For example, an acrylate resin, a polycarbonate resin, a polyethylene terephthalate resin, a polymethyl methacrylate resin, a polypropylene resin, a polystyrene resin, a polyacrylic copolymer resin, a polyolefin resin, an acrylonitrile butadiene styrene resin, a polyester resin, an epoxy resin, a polyurethane resin, a polyamide resin, or the silicone resin can be used for the material.

Next, a description will be made of an example of a manufacturing method for the key sheet 5 according to the first embodiment of the present invention. First, the key tops 6 made of a polycarbonate resin are formed by injection molding. The back surface of each of the key tops 6 is applied with decoration such as a number or a character by printing. After that, the back surface of each of the key tops 6 is applied and laminated with the adhesive layer 4 made of an UV adhesive. The resultant key tops 6 are fixed to the surface of the soft sheet 7 formed of a urethane film Esmer URS (trade name) manufactured by Nihon Matai Co., Ltd) having a thickness of 50 μm through intermediation of the adhesive layers 4, thereby obtaining the upper member P1 for the key sheet 5. On the other hand, the EL emitting layers 9 and the insulating layer 10 are formed by printing on the surface of the hard resin film 8*b* formed of a polyethylene terephthalate film (Lumirror S10 (trade name) manufactured by Toray Industries Inc.) having a thickness of 50 μm, for example. After that, the back surface of the hard resin film 8*b* is applied with an ultraviolet curing acrylate resin to form the pushers 12, thereby obtaining the lower member P2 including the hard sheet 8. As described above, the key sheet 5 composed of two members, that is, upper and lower members, can be obtained.

Figure 4:
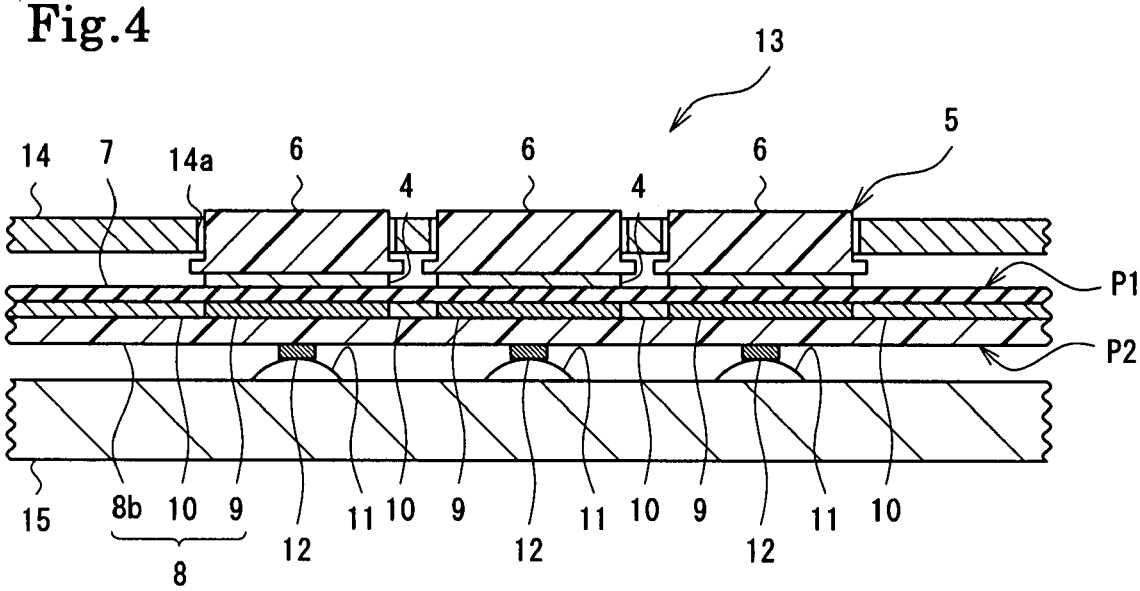
FIG. 4 is a partial sectional view of an apparatus including the key sheet according to the first embodiment of the present invention.

The key sheet 5 thus obtained according to the first embodiment of the present invention is, as shown in FIG. 4, placed on a substrate 15, which is provided with belleville springs 11 serving as contact switches in a casing 14 of the apparatus, to constitute a pushbutton switch 13 together with the substrate 15. That is, the lower member P2 of the key sheet 5 is arranged in a state where the pushers 12 are aligned with the contact switches 11 and the back surface of the lower member P2 is spaced apart from the surface of the substrate 15. An outer periphery of the lower member P2 is adhered to the substrate 15 by a two-sided tape (not shown). Further, the upper member P1 of the key sheet 5 is placed on the surface of the lower member P2 while being aligned with the lower member P2 such that the key tops 6 are exposed to an outside through operation openings 14*a* of the casing 14 and the EL emitting layers 9 of the hard sheet 8 are positioned directly below the respective key tops 6.

Lastly, a description will be made of an operational effect of the key sheet 5 according to this embodiment and the pushbutton switch used the key sheet 5.

Figure 5:
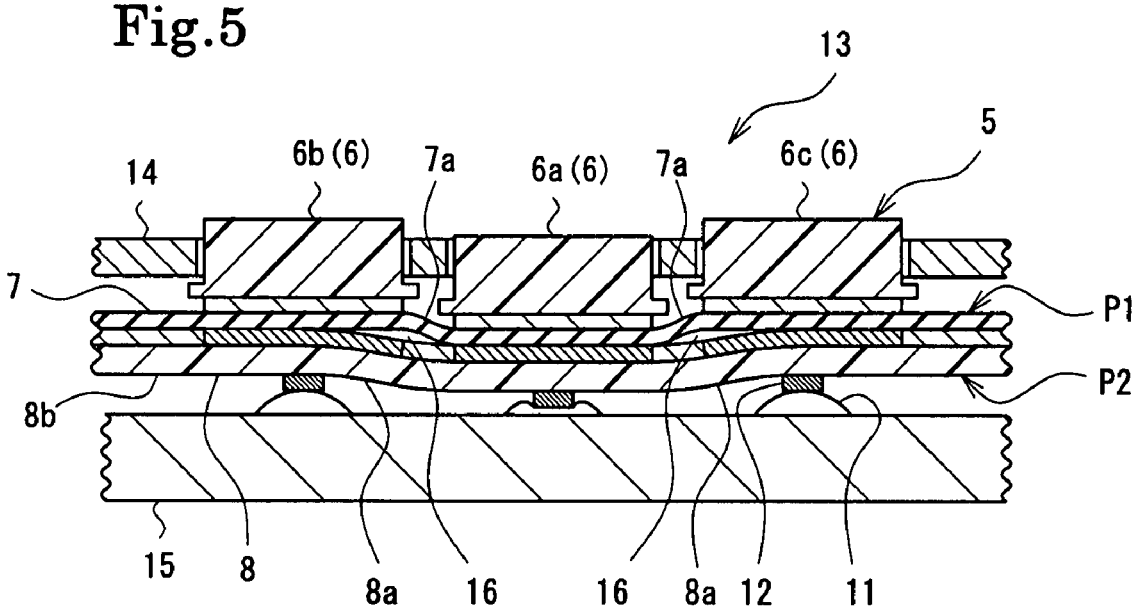
FIG. 5 is a schematic sectional view showing a state where a key top of the key sheet according to the first embodiment of the present invention is depressed.

According to the key sheet 5 of the first embodiment, as shown in FIG. 5, for example, when a key top 6*a* shown at a center in FIG. 5 is depressed, a portion 7*a* of the soft sheet 7 surrounding a periphery of the key top 6*a*, that is, the portion 7*a* of the soft sheet positioned between the central key top 6*a* and key tops 6*b* and 6*c* therearound is partially deformed to a large degree. On the other hand, the hard sheet 8 is flexed entirely in a wide portion along a plane direction (right and left directions of FIG. 5) of the hard sheet 8 with the central key top 6 being a center, that is, to a portion extending to a portion 8*a* directly below the key tops 6*b* and 6*c*. As a result, a clearance portion 16 between the soft sheet 7 and the hard sheet 8 is formed. Therefore, the left and right key tops 6*b* and 6*c* do not move in conjunction with each other, thereby making it possible to prevent erroneous input. Further, the peripheral key tops 6*b* and 6*c* are not affected by the depressing operation of the central key top 6*a*, thereby making it possible to suppress a depressing operation load to be small.

The EL emitting layer 9 is a planar illuminator, so the EL emitting layer does not require an installation space like that of an LED, thereby making it possible to realize reduction in thickness of the key sheet 5.

The pushbutton switch 13 including the key sheet 5, has a structure in which the hard sheet 8 is positioned on and fixed to the substrate 15. Therefore, the pushers 12 provided to the hard sheet 8 do not become misaligned with the contact switches 11. Thus, when the key top 6 is depressed, the contact switch 11 can be correctly depressed. Note that, in this embodiment, a two-sided tape is used for positioning and fixing, but the positioning and fixing may be performed by forming through holes in the hard sheet 8 and inserting fitting pins protruding from the substrate 15 into the through holes.

Second Embodiment

FIGS. 6 to 9

Figure 6:
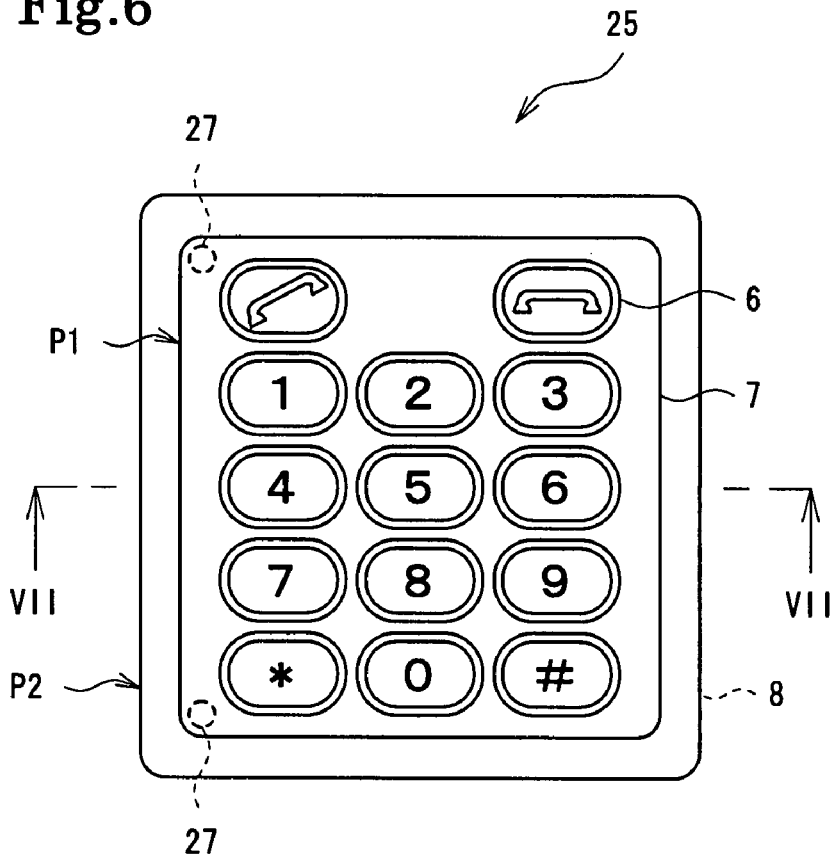
FIG. 6 is a plan view of a key sheet according to a second embodiment of the present invention.
Figure 7:
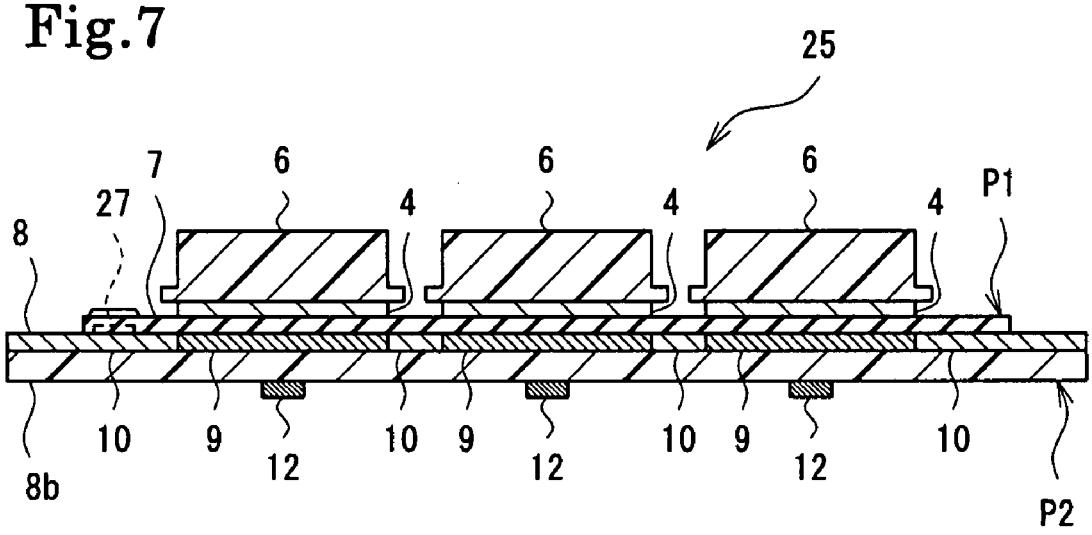
FIG. 7 is a sectional view taken along the line VII-VII of FIG. 6.

A key sheet 25 of a second embodiment of the present invention is shown in FIGS. 6 and 7. The key sheet 25 differs from the key sheet 5 of the first embodiment of the present invention in that the key sheet 25 has a structure in which the upper member P1 and the lower member P2 are partially fixed to each other to thereby constitute a single member of the upper member P1 and the lower member P2 which are integrated to each other. Other constructional details thereof are the same as those of the key sheet 5.

Figure 8:
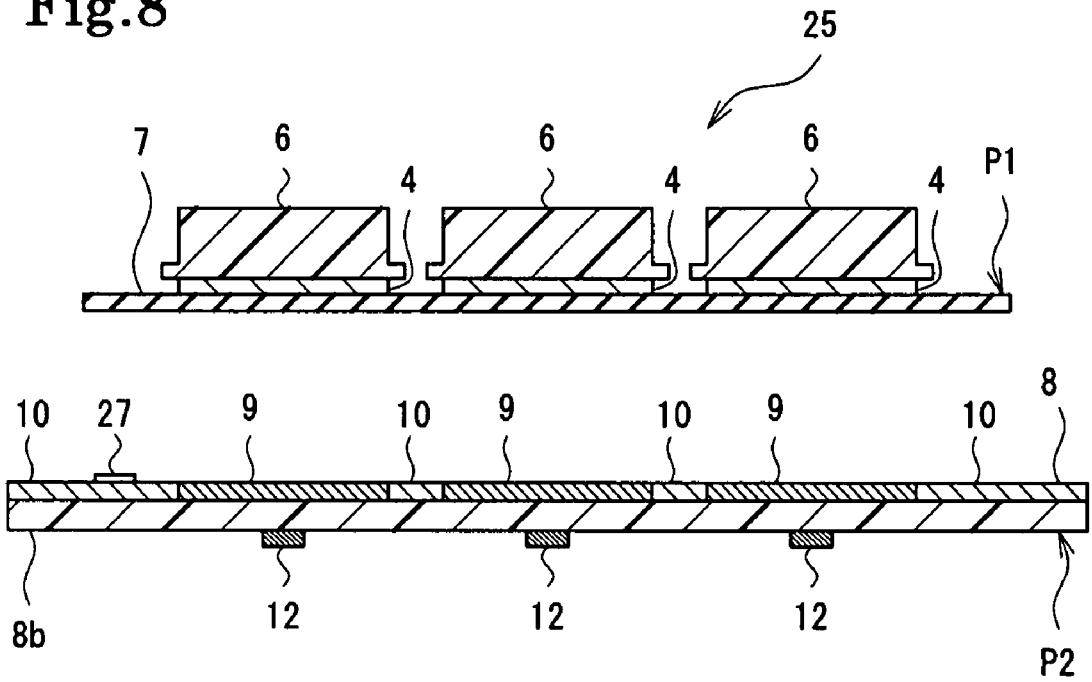
FIG. 8 is a sectional view of an upper member and a lower member of the key sheet according to the second embodiment of the present invention.

The key sheet 25 is, as shown in FIG. 8, formed of the upper member P1 the same as that of the first embodiment and the lower member P2 the same as that of the first embodiment. As shown in FIGS. 6 and 7, the upper member P1 and the lower member P2 are fixed to each other in two fixing portions on a left end of the upper member P1 in FIGS. 6 to 9 by adhesive layers 27. The key sheet 25 has a structure in which, when one of the key tops 6 is depressed, except in the fixing portions, the lower member P2 can be spaced apart from the upper member P1.

Next, a description will be made of an example of a manufacturing method for the key sheet 25 according to the second embodiment of the present invention. As in the same manner with the first embodiment, the key tops 6 made of a polycarbonate resin are formed by the injection molding. The back surface of each of the key tops 6 is applied with decoration such as a number or a character by printing, and after that, is applied and laminated with the adhesive layer 4 made of the UV adhesive. Each of the key tops 6 is fixed to the surface of the soft sheet 7 made of a polyurethane resin through the intermediation of the adhesive layer 4, thereby obtaining the upper member P1 of the key sheet 5. On the other hand, the EL emitting layers 9 and the insulating layer 10 are formed on the surface of the hard resin film 8*b* made of a polyethylene terephthalate resin by printing. After that, an ultraviolet curing acrylate resin is applied on the back surface of the hard resin film 8*b* to form the pushers 12. As a result, the lower member P2 formed of the hard sheet 8 is obtained. Further, the adhesive layers 27 made of instant adhesive are applied to the lower member P2, and the upper member P1 is adhered thereto. As a result, the key sheet 25 as a single body can be obtained.

Figure 9:
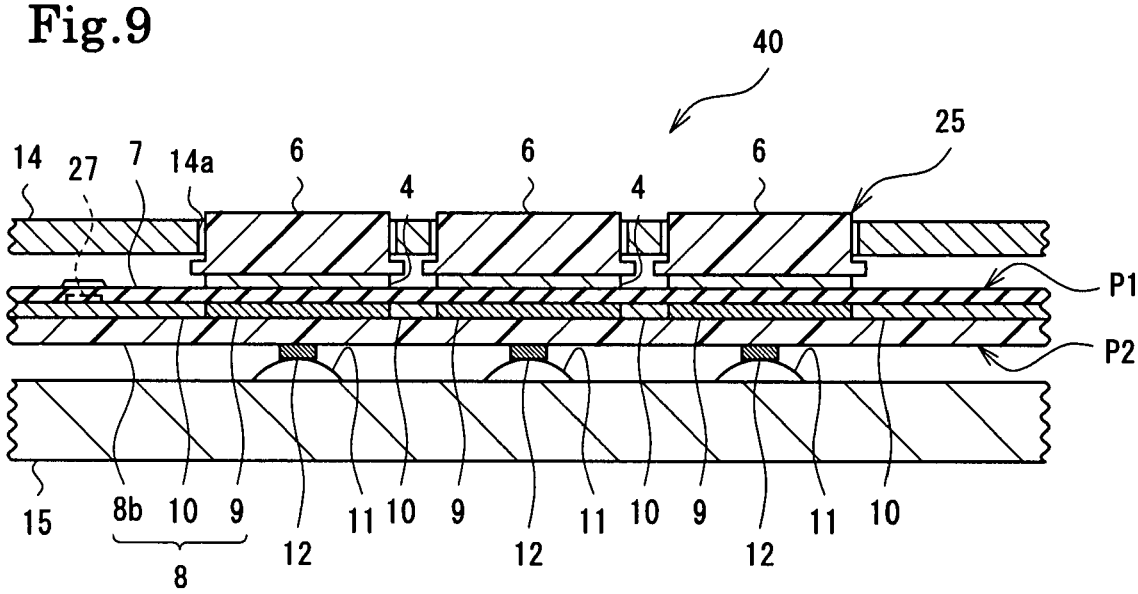
FIG. 9 is a partial sectional view of an apparatus including the key sheet according to the second embodiment of the present invention.

The key sheet 25 thus obtained according to the second embodiment of the present invention is, as shown in FIG. 9, placed on the substrate 15, which is provided with belleville springs 11 serving as contact switches in a casing 14 of the apparatus, to constitute a pushbutton switch 40 together with the substrate 15. That is, the key sheet 25 has a structure in which the lower member P2 is arranged in a state where the pushers 12 on the lower member P2 are aligned with the contact switches 11 and the back surface of the lower member P2 is spaced apart from the surface of the substrate 15, and the outer periphery of the lower member P2 is adhered and fixed to the substrate 15 by a two-sided tape (not shown). The key tops 6 of the upper member P1 are exposed to the outside through the operation openings 14*a* of the casing 14.

The key sheet 25 of the second embodiment of has the same operational effect as that of the key sheet 5 of the first embodiment, and further has the following operational effect.

In the key sheet 25, the upper member P1 is fixed to the lower member P2 at one end of the lower member P2. Therefore, at the time of assembly to the apparatus, positioning of the upper member P1 and positioning of the lower member P2 are not performed separately, and the key sheet 25 can be positioned and assembled. The lower member P2 has fixed form properties. Therefore, even when the upper member P1 does not have the fixed form properties, the assembly is easy.

Modification of Embodiments

A part of the first embodiment or the second embodiment can be modified as described below.

Instead of forming a display portion on each of the key tops 6, including decoration such as a character, a symbol, a figure, or a pattern, the display portion may be formed on the soft sheet 7 or the hard sheet 8. The soft sheet 7 may be provided with a light blocking layer for blocking light applied from a portion other than a desired portion. The display portion and the light blocking layer provided on the soft sheet 7 are preferably soft so as not to prevent flexing of the soft sheet 7.

For fixing the key tops 6 and the soft sheet 7 to each other, in addition to the UV adhesive, thermosetting or other photosetting adhesives, a hot melt adhesive, an adhesive tape or the like can be used. Alternatively, the fixation by in-mold molding may also be performed. Fixation between the hard resin film 8*b* and the pushers 12 can be performed by an adhesive or the in-mold molding.

Figure 10:
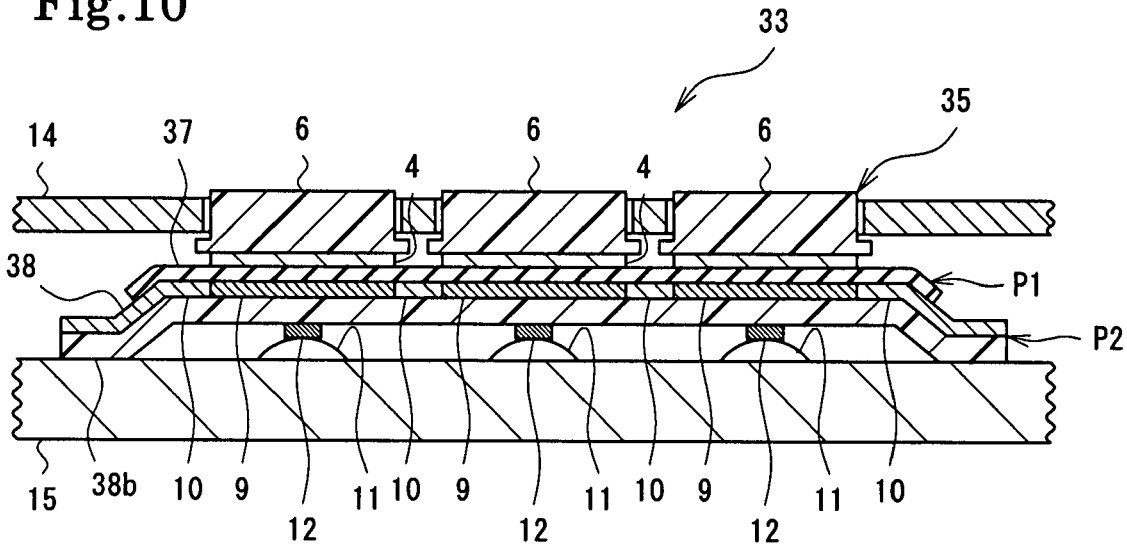
FIG. 10 is a partial sectional view of an apparatus including a key sheet according to a modification example of the embodiments of the present invention.

The key sheet 5, 25 is fixed to the substrate 15 by the two-sided tape at an end of the key sheet 5, 25. Alternatively, like a key sheet 35 used for a pushbutton switch 33 shown in FIG. 10, end portions of a soft sheet 37 and a hard sheet 38 are bent such that sections thereof constitute convex shapes, and those may be fixed to the substrate 15 at the end portions of the hard sheet 38 by an adhesive.

Figure 11:
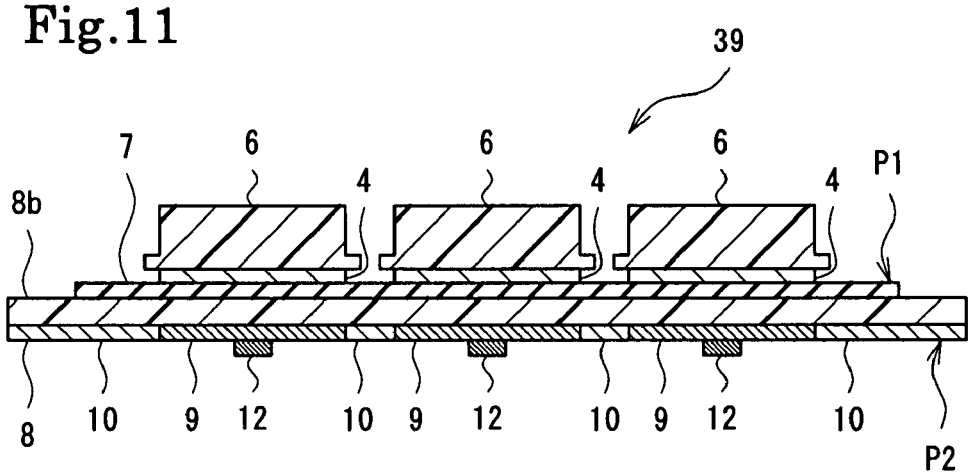
FIG. 11 is a sectional view of the key sheet according to the modification example of the embodiments of the present invention, corresponding to FIG. 2.

While an example is shown in which the EL emitting layers 9 and the insulating layer 10 are provided on the surface of the hard sheet 8, like the key sheet 39 shown in FIG. 11, the EL emitting layers 9 and the insulating layer 10 may be provided on a back surface side of the hard sheet 8. In this case, the EL emitting layer 9 is structured by successively laminating from the back surface of the hard resin film 8*b*, a transparent electrode, a light emitting layer, an dielectric layer, and a back plate. The hard resin film 8*b* is required to be a translucent sheet so as to allow passage of light therethrough.

Figure 12:
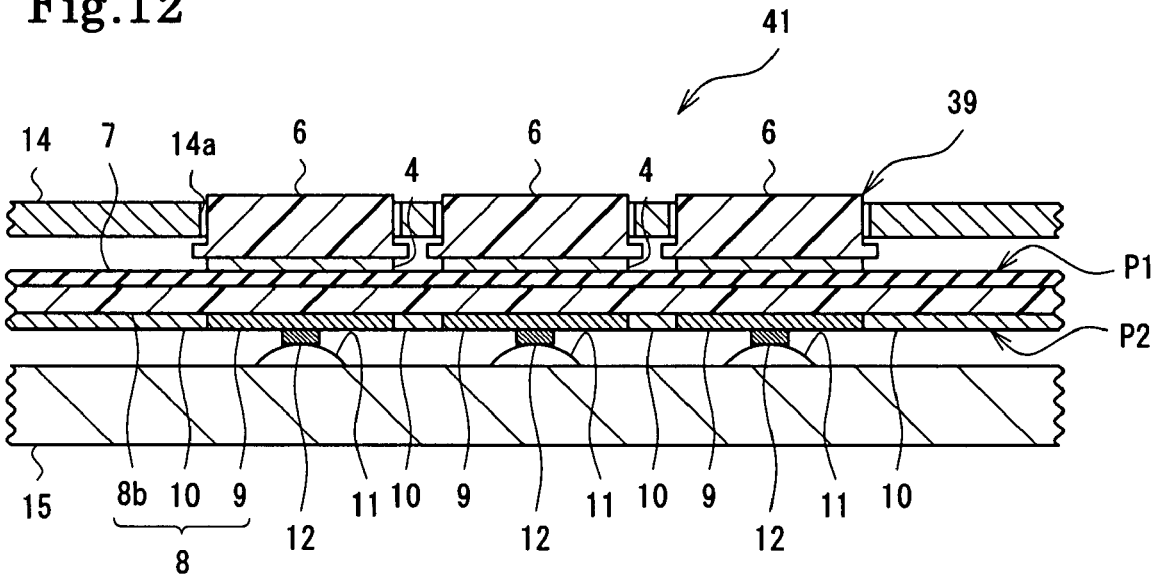
FIG. 12 is a partial sectional view of an apparatus including the key sheet according to the modification example of the embodiments of the present invention.
Figure 13:
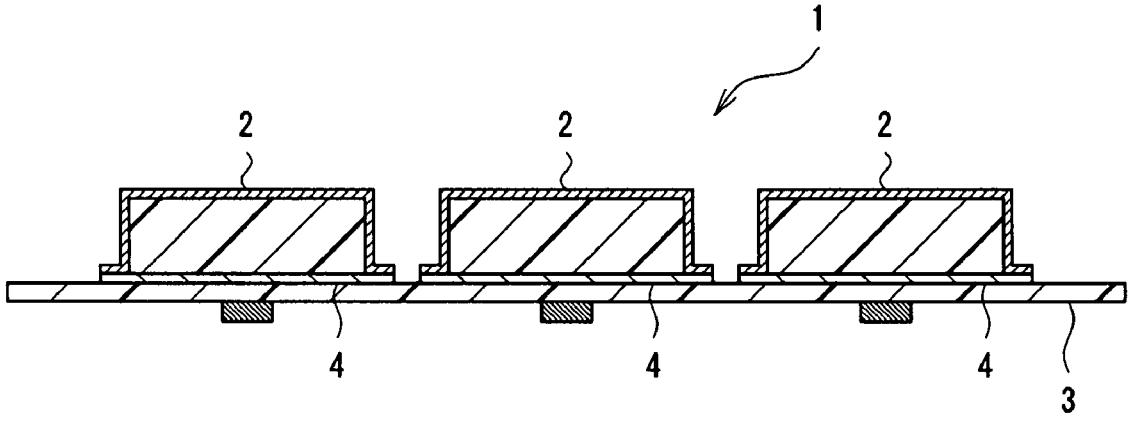
Fig.13 Related Art
FIG. 13 is a sectional view of a key sheet according to a related art, corresponding to FIG. 2.

The key sheet 39 is, as shown in FIG. 12, placed on the substrate 15 provided with the belleville springs 11 as contact switches in the casing 14 of the apparatus, thereby forming a pushbutton switch 41 together with the substrate 15. That is, the lower member P2 of the key sheet 39 is arranged in a state where the pushers 12 are aligned with the contact switches 11 and the back surface of the lower member P2 is spaced apart from the surface of the substrate 15, and the outer periphery of the lower member P2 is adhered and fixed to the substrate 15 by a two-sided tape (not shown). Further, the upper member P1 of the key sheet 5 is aligned with the lower member P2 and placed on the surface thereof such that the key tops 6 are exposed to the outside through the operation openings 14*a* of the casing 14 and the EL emitting layers 9 of the hard sheet 8 are positioned directly below the respective key tops 6.

The hard sheet 8 is provided with the EL emitting layers 9, or alternatively, may be provided as a different circuit sheet. In this case, the circuit sheet refers to a sheet on which a circuit pattern is formed by printing or etching. For example, instead of the EL emitting layers 9, digital or analog capacitance switches (touch panels) can be provided by printing or copper-foil etching. With this structure, by depressing the key top 6 to a degree that the belleville spring 11 is pushed in, the capacitance switches can function as pushbutton keys. On the other hand, by depressing the key top 6 to a degree that while the belleville spring 11 is not pushed in, the capacitance switch is depressed, the capacitance switches can function as pointing devices which allow position recognition. That is, when a finger is moved from the key top 6 indicating the number "1" of FIG. 1 to the key top 6 indicating the number "3", for example, the capacitance switches positioned under the corresponding key tops 6 sequentially sense the movement, and a signal for indicating this can be converted into an operation of moving a cursor from an upper left position to an upper right position on a display.

In the above embodiments, there is provided the circuit sheet having the structure in which the hard sheet 8 is provided with the EL emitting layers 9 and the like. However, the circuit sheet may have a structure in which no EL emitting layer 9 is provided and the hard sheet 8, 38 is formed only of the hard resin film 8*b*.

What is claimed is:

1. A key sheet arranged on a substrate having a contact switch in a casing of an apparatus, comprising:

an upper member formed of a plurality of key tops which are exposed to an outside through operation openings formed in the casing, and a soft sheet fixed to back surfaces of the plurality of key tops, wherein a space between the plurality of key tops defines an interval; and a lower member which is formed of a hard sheet, on which the upper member is placed, and which forms a clearance portion under the interval between the plurality of key tops by which the lower member is spaced apart from the upper member when the key top is depressed.

2. A key sheet according to claim 1, wherein:

the soft sheet is made of a rubber elastic material having a tensile elongation of 400% or more and a tensile stress of 100 MPa or less when elongation is 100%; and the hard sheet has flexibility allowing deformation at a time of a depressing operation, and a restoration force for restoring the hard sheet when the depression is released.

3. A key sheet according to claim 1, wherein the hard sheet comprises a circuit sheet.

4. A key sheet according to claim 1, wherein the hard sheet comprises EL emitting layers for illuminating the key tops.

5. A key sheet according to claim 1, wherein a total thickness of the soft sheet and the hard sheet is 200 μm or less.

6. A key sheet according to claim 1, wherein the soft sheet is adhered and fixed to an end of the hard sheet.

7. A key sheet according to claim 1, wherein:

the soft sheet and the hard sheet have end portions which are bent toward the substrate; and the end portion of the hard sheet can be fixed to the substrate.

8. A key sheet according to claim 4, wherein the EL emitting layers are provided on a surface of the hard sheet.

9. A key sheet according to claim 4, wherein the EL emitting layers are provided on a back surface of the hard sheet.

10. A pushbutton switch, comprising:

a substrate having a contact switch; and a key sheet for depressing the contact switch, the key sheet being arranged on the substrate, wherein:

the substrate comprises a belleville spring as the contact switch; and the key sheet comprises the key sheet according to any one of claims 1 to 9.

11. A key sheet according to claim 1, wherein the hard sheet is provided with a capacitance switch.

12. A key sheet according to claim 1, wherein the soft sheet is covered substantially by and fixed to the back surfaces of the key tops.

* * * * *